US005273378A

United States Patent [19]

Merz et al.

[11] Patent Number: 5,273,378

[45] Date of Patent: Dec. 28, 1993

[54] SUPPORT COLUMN

[76] Inventors: Volker Merz, Im Neuen Acker 8, 5860 Iserlohn; Kurt Plaga, Wiescherstrasse 94, 4690 Herne 1, both of Fed. Rep. of Germany

[21] Appl. No.: 934,660

[22] PCT Filed: May 4, 1992

[86] PCT No.: PCT/DE92/00376

§ 371 Date: Jan. 11, 1993

§ 102(e) Date: Jan. 11, 1993

[87] PCT Pub. No.: WO92/20903

PCT Pub. Date: Nov. 26, 1992

[30] Foreign Application Priority Data

May 10, 1991 [DE] Fed. Rep. of Germany ..... 4115209

[51] Int. Cl.[5] ..... E21D 15/14

[52] U.S. Cl. ..... 405/290; 248/354.4; 248/354.2; 405/288

[58] Field of Search ..... 405/290, 288, 303; 248/354.2, 354.4

[56] References Cited

U.S. PATENT DOCUMENTS 4,726,714 2/1988 MacArthur .

FOREIGN PATENT DOCUMENTS

2847906A1 5/1979 Fed. Rep. of Germany .
2941663A1 5/1980 Fed. Rep. of Germany .
3213468A1 10/1983 Fed. Rep. of Germany .
3624168A1 1/1988 Fed. Rep. of Germany .
8712289.8 2/1989 Fed. Rep. of Germany .
3915837A1 11/1990 Fed. Rep. of Germany .
908635 10/1945 France ..... 405/290
1603025 11/1981 United Kingdom ..... 405/290

*Primary Examiner*—Dennis L. Taylor
*Attorney, Agent, or Firm*—Feiereisen & Kueffner

[57] ABSTRACT

Support column for underground mining and tunnel construction, composed of a load-bearing outer shell and a core of a substance which is to be introduced in the flowable state and is capable of hardening. The upper column component can be slid out of the lower column component and is secured against being slid into the lower column component by a ring-shaped spring element. Active clamping forces can be introduced by means of clamping devices which can be mounted on the outside.

17 Claims, 3 Drawing Sheets

SUPPORT COLUMN

BACKGROUND OF THE INVENTION

1. Field of the Invention

The invention relates to a support column for underground mining and tunnel construction which is composed of a load-bearing outer shell and a core of a substance which is to be introduced in the flowable state and which is capable of hardening.

2. Description of the Related Art

Support columns are known and are described in DE-OS 28 47 906 and DE-OS 39 15 837. In practice, it has been found that it is frequently necessary, for rock-mechanical reasons, to mount columns with defined setting forces and to apply a load to the column. The above-mentioned columns or stays reach their full load-bearing capacity only after the substance which has been filled in has hardened. It is known from DE-OS 28 47 906 that a certain early load-bearing capacity can be achieved by providing an auxiliary stay which remains on the column until the substance in the column has hardened. DE-OS 39 15 837 describes a clamping possibility which is effected by means of a winding mechanism. In this case, the magnitude of the clamping forces is limited and cannot be adapted to the rock-mechanical requirements. In this construction, the complicated winding mechanism remains in the filled column and loses its function after the column has been filled. In systems which are not reusable, such a procedure is not economical.

The invention is based on the objective of developing a support column of the above-described type which makes it possible in an economical manner to obtain an immediate support force in accordance with the given rock-mechanical requirements before filling in and hardening of the substance and which maintains this support force even after the clamping device has been removed.

In accordance with the invention, this objective is met by providing an upper column component which is slidable out of a lower column component and is secured against sliding into the lower column component by means of a ring-shaped spring element which is secured relative to the upper column component, the lower column component, and a sectional ring, wherein the spring element is constructed in such a way that the pretensioned spring force permits sliding of the upper column component out of the lower column component and, after the support column has been clamped, the contour of the spring element bearing against the upper column is connected therewith in a positively engaging manner.

Advantageous embodiments are the subject matter of dependent claims.

Machine elements which prevent a longitudinal movement of parts which are inserted one into the other are generally known in the art. Such elements are, for example, resilient securing rings which prevent an axial displacement in one direction on smooth shafts or axles.

However, it is novel and inventive to equip support columns with such spring elements.

Additional details of the invention will be described in the following with the aid of schematically illustrated embodiments.

BRIEF DESCRIPTION OF THE PREFERRED EMBODIMENT

Figure 1:
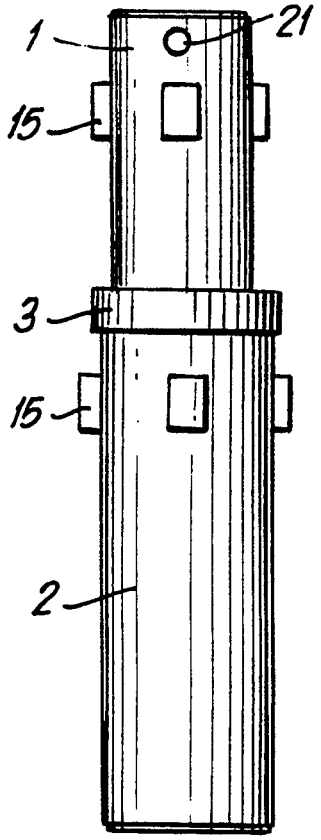
FIG. 1 is an elevational view of a support column.
Figure 2:
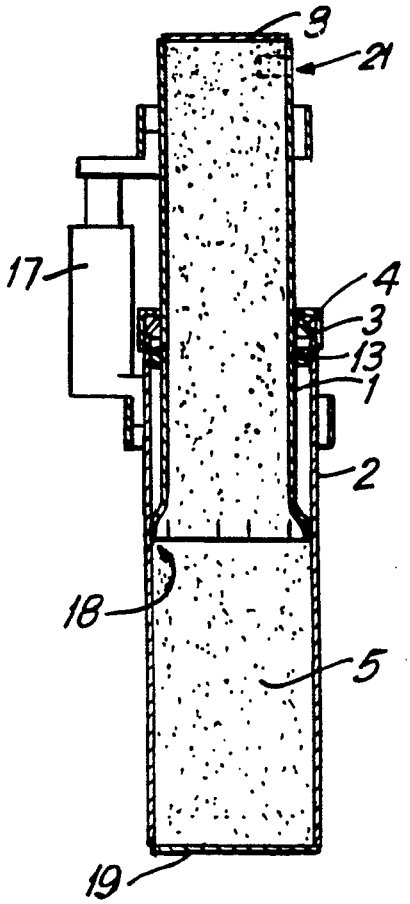
FIG. 2 is a longitudinal sectional view of a support column with clamping device and shows the arrangement of the ring-shaped spring element.
Figure 3:
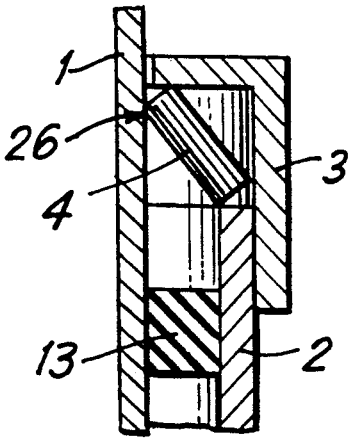
FIG. 3 shows a detail, on a larger scale, in the area of the spring element.
Figure 4:
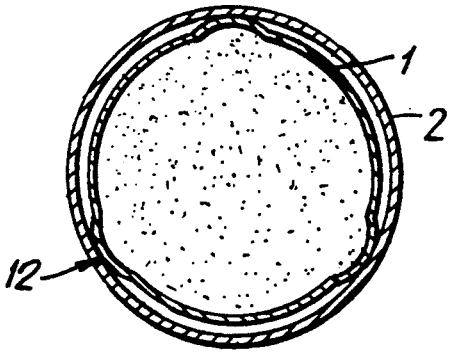
FIG. 4 is a horizontal sectional view of the support column in the area of increased diameter portion.
Figure 5:
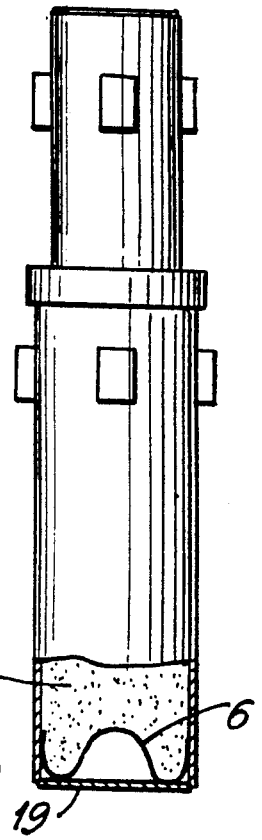
FIG. 5 is a partial sectional view of the base area of the lower column component with a shaped part placed in the lower column component.
Figure 6:
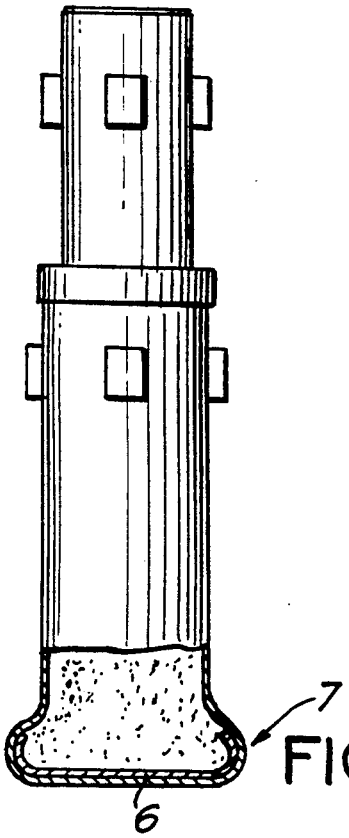
FIG. 6 is a partial sectional view of the base portion of the lower column component after deformation.
Figure 7A:
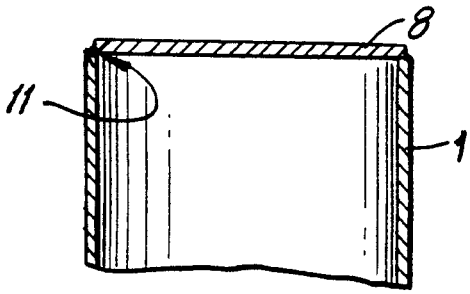
FIG. 7A is a partial section view of the head portion of the upper column component.
Figure 8A:
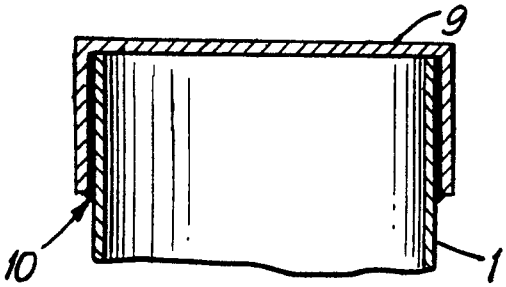
FIG. 8A is a partial section view of the head portion of the upper column component.
Figure 7B:
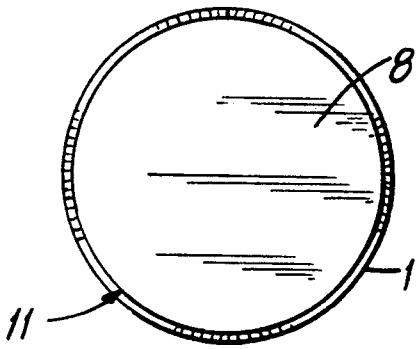
FIG. 7B is a top view of the head portion of the upper column component.
Figure 8B:
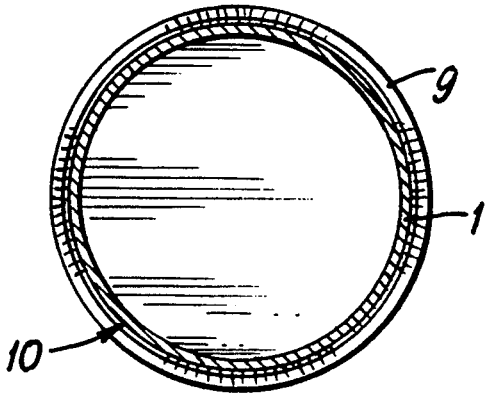
FIG. 8B is a cross-sectional view of the head portion of the upper column component.
Figure 9:
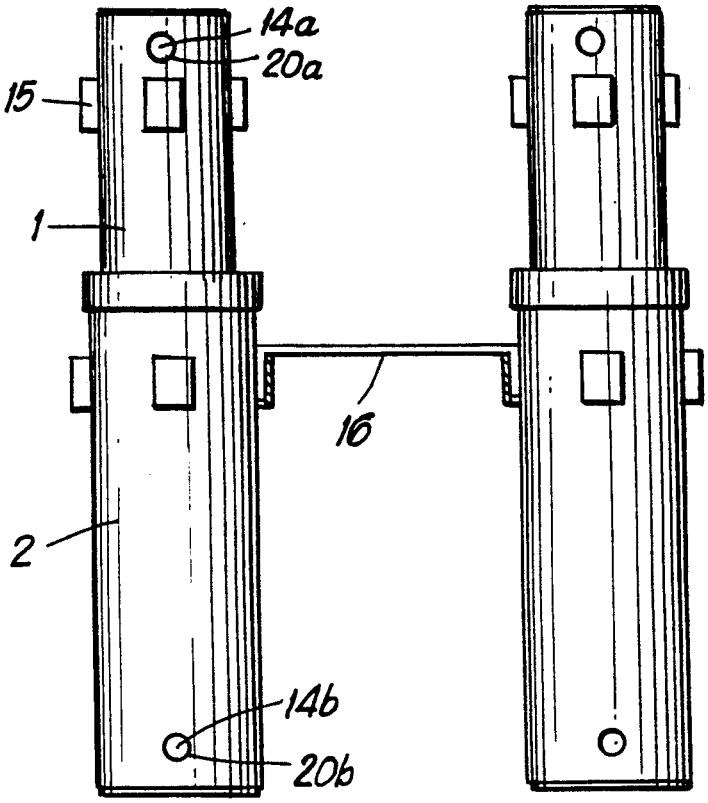
FIG. 9 is an elevational view of the support column with additional possibilities for connection.
Figure 10:
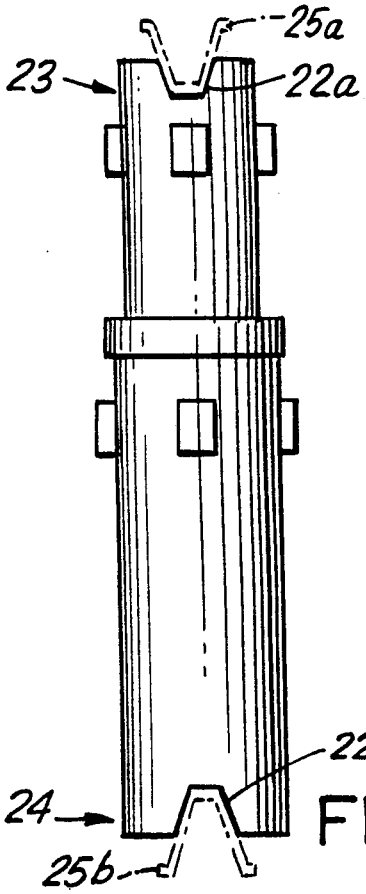
FIG. 10 is an elevational view of the support column with additional possibilities for connection.
Figure 11A:
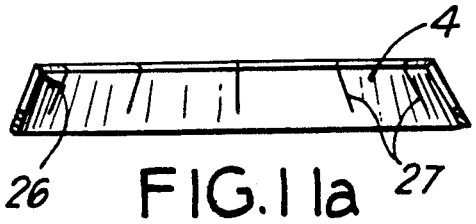
FIG. 11A is a cross-sectional view of the ring-shaped spring element.
Figure 11B:
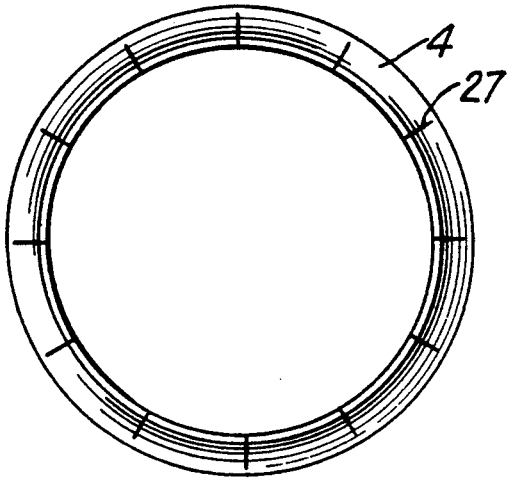
FIG. 11B is a top view of the ring-shaped element.

In the embodiment of the support column according to the invention, hollow sections, preferably tubes with circular cross section, are inserted into each other in such a way that they are slidable. For this purpose, a gap in which a sealing member 13 can be mounted is required between the outer diameter of the upper column component 1 and the inner diameter of the lower column component 2. To ensure that the two column components remain after sliding out in the predetermined position, a ring-shaped spring element 4 is provided at the upper end of the lower column component 2. In the preferred embodiment, this spring element is constructed as a cone-shaped, slotted ring and rests with its greater diameter on the upper end of the lower column component 2 and on the inner diameter of the sectional ring 3. With its inner contour 26, which is constructed as a cutting edge, the spring element 4 rests against the outer diameter of the upper column component 1. When the upper column component 1 is slid out, a change of the position of the spring element 4 is prevented by the upper side of the sectional ring 3 which faces the outer diameter of the upper column component 1. The ring-shaped spring element 4 is constructed in such a way that the existing pretensioning force of the spring element 4 permits the sliding out of the upper column component 1, and when a load is applied on the support column in longitudinal direction, the column components are prevented from sliding into each other by a cutting edge provided at the inner contour 26 of the spring element 4 which is in positively locking engagement with the upper column component 1.

In another advantageous embodiment, the spring element 4 is provided with transverse slots 27, as claimed in claim 13. The transverse slots 27 cause a reduction of the spring stiffness. Depending on the number and arrangement of transverse slots 27, a predetermined adjustment of the pretensioning force is possible. The upper and lower column components 1, 2 are provided with receiving members 15 which can receive one or more clamping devices 17. These clamping devices preferably are constructed as hydraulic cylinders. By using one or more hydraulic cylinders, which may be operated with variable setting pressures, a defined setting load can be applied which is adapted to the rock-mechanical requirements. In addition, it is possible to effect sliding out and clamping of the support column by means of suitable building material pumps.

It is necessary that the play between the inner diameter of the lower column component 2 and the outer diameter of the upper column component 1 has a dimension which is necessary for the guidance. For this purpose, the lower end 18 of the upper column component 1 has at least three increased diameter portions 12 which are distributed over the circumference. These increased diameter portions 12 are preferably arranged uniformly distributed over the circumference. For this type of support, such a guidance, in which the manufacture is simpler and less expensive than in guide elements mounted by means of welding or other methods, is sufficient.

For filling the support column, an opening 21 provided with a valve is arranged in the upper portion of the upper column component 1.

In known support columns of the above-mentioned type, ventilation and drainage are effected by means of bores which are covered with filter cloths. The support column according to the invention is ventilated and drained through gaps 10, 11. These gaps are created by joining the upper column component 1 and the cover 8, wherein these parts are welded together only over sections thereof. Particularly helpful for the creation of the gaps are a coarse cutting procedure in the manufacture of the hollow sections for the upper column component 1, together with the unfinished surface of the cover 8. The utilization of these situations represents a considerable reduction in expenses because additional work steps for providing bores and covering these bores with filter cloths are omitted.

A further improvement of the ventilation and drainage system is produced by placing a cap 9 on the upper end of the upper column component 1. In this case, excessive media are discharged by flowing through the annular gap 10 in longitudinal direction of the support column. As a result of this arrangement, operating personnel are not impaired by any ejected media.

In special cases, it is necessary to provide the otherwise rigid support columns with a resiliency. For this purpose, a shaped part 6 is loosely placed on the bottom 19. When an overload occurs, the solidified substance 5 will initially deform the shaped part 6, causing the substance 5 to be comminuted, and a lateral expansion occurs subsequently. An upset portion 7 is formed in the bottom area. In this process, the shaped part 6 reinforces the bottom area. The upsetting produces an enlargement of the support surface and reduces the surface pressure. As a result, the support column to which a load has been applied is prevented from sinking in.

Another advantage of the support column is the fact that, after clamping, the receiving parts 15 can be utilized for other connection possibilities. By inserting spacer members 16 in the receiving parts 15, the support columns can be mounted in accordance with the given requirements with uniform spacing without requiring complicated measuring procedures. Simultaneously, these spacer members secure against falling any support columns which have not yet been clamped. As a result, particularly the manipulation of long support columns is facilitated. The receiving parts 15 further make it possible to combine individual support columns to form composite columns. A ring-shaped arrangement of the receiving part 15 makes it possible to connect support columns in any chosen direction with each other.

It is an advantage to provide the ends of the upper and lower column components 1, 2 with continuous bores **14*a*, 14*b*, which are formed by hollow sections 20*a*, 20*b***. This makes it possible to mount on the support column various components, such as base plates or head plates, or to connect the support columns in diagonal or horizontal positions to other support systems.

Another advantageous configuration of the support column ends 23, 24 is achieved by constructing the cover **22*a* and the bottom 22*b* in such a way that other structural components can be received in a positively locking manner by the cover 22*a* and the bottom 22*b***. This causes an introduction of existing forces in the middle of the support column and prevents the support column from sliding away laterally.

We claim:

1. A support column for underground mining and tunnel construction, comprising a load-bearing outer shell and a core of a substance which can be filled in the flowable state and is capable of hardening, a lower column component (2) and an upper column component (1) mounted so as to be slidable out of the lower column component (2), the upper column component (1) being secured against sliding into the lower support component (2) by means of a ring-shaped spring element (4) which bears against the upper column component (1), the lower column component (2) and a sectional ring (3), the upper column component being fixed in its position by the sectional ring (3), wherein the spring element (4) is constructed such that the pre-tensioned spring force permits the upper column component (1) to slide out and, after the support column has been clamped, the contour (26) of the spring element (4) bearing against the upper support column (1) is connected therewith in a positively locking manner.

2. Support column according to claim 1, wherein at least one receiving part (15) each for receiving a clamping device (17) is arranged on the upper column component (1) and the lower column component (2).

3. Support column according to claim 1, wherein the upper column component (1) is provided for guidance in the lower column component (2) at its lower end (18) with at least three increased diameter portions (12) which are distributed over the circumference.

4. Support column according to claim 1 wherein, for ventilation and drainage of the substance filled into the support column, a cover (8) is connected to the upper column component (1) in a manner which is at least one of not water-tight and not gas-tight.

5. Support column according to claim 1, wherein, for ventilation and drainage of the substance filled into the support column a cap (9) is connected to the upper column component (1) in a manner which is not water-tight and not gas-tight, and wherein the discharged media are conducted in longitudinal direction of the support column.

6. Support column according to claim 1, wherein a shaped part (6) is placed on the bottom (19) of the lower column component (2), and wherein the shaped part (6) produces and reinforces a predetermined deformation and expansion of the base portion (7) when an overload is applied.

7. Support column according to claim 1, wherein a continuous opening (14*a*) which is formed by a hollow section (20*a*) is provided at the end of the upper column component (1) for receiving added components.

8. Support column according to claim 1, wherein a rod section is provided at the upper column component (1) for receiving added components.

9. Support column according to claim 2, wherein the receiving part (15) is a sectional ring.

10. Support column according to claim 2, wherein spacer members (16) are fastened to the receiving parts (15).

11. Support column according to claim 1, wherein a cover (22*a*) of the upper column component (1) is constructed at an end (23) thereof in such a way that the cover (22*a*) can be connected in a positively engaging manner with other structural elements (25*a*).

12. Support column according to claim 1, wherein the structural components of the column are of a metal material which is resistant to aggressive media.

13. The support column according to claim 1, wherein the spring element (4) is ring-shaped and has radial slots (27) arranged over the circumference thereof.

14. Support column according to claim 1, wherein a continuous opening (14*b*), which is formed by a hollow section (20*b*), is provided at the end of the lower column component (2) for receiving added components.

15. Support column according to claim 1, wherein a rod section is provided at the lower column component (2) for receiving added components.

16. Support column according to claim 2, wherein additional added parts are fastened to the receiving parts (15).

17. Support column according to claim 1, wherein a bottom (22*b*) of the lower column component (2) is constructed at an end (24) thereof in such a way that the bottom (22*b*) can be connected in a positively engaging manner with other structural elements (25*b*).

* * * * *